US005366776A

United States Patent [19]

Mertens

[11] Patent Number: 5,366,776

[45] Date of Patent: Nov. 22, 1994

[54] PAD ASSEMBLY

[75] Inventor: Timothy A. Mertens, Cottage Grove, Minn.

[73] Assignee: Minnesota Mining and Manufacturing Company, St. Paul, Minn.

[21] Appl. No.: 84,798

[22] Filed: Jun. 29, 1993

[51] Int. Cl.[5] ..... B42D 15/00

[52] U.S. Cl. ..... 428/40; 283/35; 283/36; 283/37; 283/38; 283/39; 283/40; 283/41; 428/43; 428/77; 428/137; 428/138; 428/192; 428/194; 428/202; 428/212; 428/220; 428/354; 428/511; 462/55; 462/62; 462/63

[58] Field of Search ..... 428/40, 192, 194, 43, 428/137, 138, 354, 511, 77, 202, 220, 212; 281/15.1; 283/63.1, 35, 36, 37, 38, 39, 40, 41; 462/55, 62, 63

[56] References Cited

U.S. PATENT DOCUMENTS

| | | | |
|---|---|---|---|
| 2,248,317 | 7/1941 | Van Cleef | 428/194 |
| 4,416,392 | 11/1983 | Smith | 221/45 |
| 4,653,666 | 3/1987 | Mertens | 221/45 |
| 4,770,320 | 9/1988 | Miles et al. | 221/33 |
| 4,907,825 | 3/1990 | Miles et al. | 281/51 |
| 4,921,127 | 5/1990 | Windorski | 221/45 |
| 5,056,824 | 10/1991 | Olson | 283/36 |
| 5,153,041 | 10/1992 | Clements et al. | 428/40 |

*Primary Examiner*—Ellis P. Robinson
*Assistant Examiner*—Nasser Ahmad
*Attorney, Agent, or Firm*—Gary L. Griswold; Walter N. Kirn; William L. Huebsch

[57] ABSTRACT

A pad assembly comprising a multiplicity of flexible sheets each having (1) a similarly sized body portion that has pressure sensitive adhesive on its rear surface and is sized and adapted so that its front surface can be written on, and (2) a smaller tab projecting beyond an edge of the body portion that can be positioned to project from the edge of a sheet to which the sheet is adhered.

12 Claims, 3 Drawing Sheets

PAD ASSEMBLY

FIELD OF THE INVENTION

The present invention relates to sheets used to write notes and that can be used to mark portions of documents, which sheets have repositionable pressure sensitive adhesive coated their rear surfaces by which the sheets are adhered together in a pad prior to use, and by which an individual sheet can be removably adhered to a substrate when the sheet is in use.

BACKGROUND OF THE INVENTION

Pad assemblies are known that comprise a multiplicity of flexible sheets each having a band of repositionable pressure sensitive adhesive coated its rear surface adjacent one edge by which the sheets are adhered together in a pad prior to use, and by which the sheets can be removably adhered to various substrates when the sheet is removed from the pad assembly. Such pad assemblies of paper sheets are currently being marketed under the trademark "Post-it" Note Pads by Minnesota Mining and Manufacturing Company, St. Paul, Minn., both in versions in which all the bands of adhesive are disposed along the same side of the pad, and in versions in which the bands of adhesive are along opposite sides of the pad on each successive sheet in the pad (see U.S. Pat. No. 4,416,392) which affords convenient dispensing of the sheets from dispensers. Sheets from such pads are useful, among other things, for making written notes to be removably adhered on a sheet in a multi sheet document. After that document is subsequently closed, however, it may be difficult to again find the location of the note within the document.

Pad assemblies of polymeric sheets are also currently being marketed under the trademark "Post-it" Tape Flags by Minnesota Mining and Manufacturing Company, (See U.S. Pat. Nos. 4,770,320 and 4,907,825). Such Tape Flags can have brightly colored ends and can be positioned along the edge of a document with the brightly colored end thereof projecting from the edge of the document to mark specific portions thereof, however, the Tape Flag has only a small area that can be written on which limits its usefulness as a substrate on which notes can be taken.

While such paper notes and tape flags can be used in conjunction with each other to provide both a large area on which notes can be written and marking of the location of the note in a document, this requires separate supplies of both.

DISCLOSURE OF THE INVENTION

The present invention provides note sheets adhered together in a pad that offer the benefits of both paper note sheets with bands of repositionable adhesive on their rear surfaces and of tape flags for providing a visual indication of the location of the note sheets in a document.

According to the present invention there is provided a pad assembly comprising a multiplicity of flexible sheets each having (1) a body portion generally of the same size as the body portions of other sheets in the stack and having first and second opposite edges, and (2) a tab portion which can be smaller in surface area than the body portion projecting beyond the second edge of body portion. The sheets have pressure sensitive adhesive coated on the rear surfaces of their body portions, and the sheets are disposed in a stack with the corresponding peripheral edges of the body portions of the sheets aligned, and the pressure sensitive adhesive on each sheet removably adhering that sheet to the adjacent sheet in the stack.

The adhesive on the sheets is preferably a repositionable pressure sensitive adhesive coated in a band along the edge of the sheet opposite the tab portion. Such sheets can be used for making written notes to be removably adhered on a sheet in a multi sheet document, and can be positioned with the tab portion projecting from the edge of the document so that after the document is subsequently closed, the tab portion will indicate the sheets location making it easy to again find the sheet within the document. Alternatively, the adhesive can be located entirely over or in a pattern on the body portion of the sheet; and/or, depending on the intended use of the sheets, the adhesive can have higher adhesion in which case a suitable release material may be needed on the front surface of the sheets to afford their separation.

The pad assembly can include a plurality of different sets of sheets with the sheets in each of the sets of sheets having the same peripheral shape and having tab portions at a different location along the edges of the body portions than the locations of the tab portions along the second edges of the body portions in the other sets of sheets.

The sheets of each of the sets of sheets can be disposed adjacent each other in the stack of sheets, or, alternatively, the sheets of each of the sets of sheets can be interspersed between sheets of different sets of sheets in a predetermined pattern throughout the pad assembly.

The sheets could be entirely of polymeric material, however, preferably the sheets are of paper and each of the sheets includes a reinforcing layer along one surface of its tab portion and along the surface of an adjacent minor part of the body portion of the sheet to restrict tearing of the sheet adjacent the tab portion. Such reinforcing layers can be coatings or layers of polymeric material and can be on the front or rear surfaces of the sheets. Also the reinforcing layer can be brightly colored, and have colors contrasting to the color of the sheets; and the reinforcing layers on different sheets in the same stack can be of different colors.

The pad assembly can include a layer of padding compound disposed over and releasably adhered to the aligned first edges of the sheets in the stack, which padding compound is sufficiently flexible to allow, after the band of repositionable pressure sensitive adhesive on the rear surface of one of the sheets in the stack is separated from the front surface of the adjacent sheet in the stack, that one sheet to be pivoted away from that adjacent sheet by hinge-like flexing of the padding compound between the sheets. The layer of padding compound is sufficiently adhered to the sheets to remain adhered to the adjacent sheets during such flexing while affording manual peeling of the one sheet from the padding compound to separate that one sheet from the stack.

The body and tab portions of the sheets can be formed from a single sheet of paper. Alternatively, the body portions can be conventional rectangular paper "Post-it" note sheets, the tab portions can be of polymeric material that is free of adhesive and brightly colored provided by end portions of conventional polymeric tape flags having opposite end portions coated with repositionable pressure sensitive adhesive, which opposite end portions are removably adhered along the side surfaces of the body portions. This alternate embodiment allows the body portion and the tab portion to be separated during use so that the body portion or paper note may be releasably adhered along the middle portion of a sheet in a multi page document, and the tape flag may be used along the edge portion of that sheet to indicate its location after the document is closed.

In another embodiment of the pad assembly, the sheets are perforated along their second edges between the body portions and the tab portions, and the tab portions are perforated at about right angles to the second edges of the body portions to define a plurality of tab portion parts along the tab portions. The sheets include layers of cohesive on one of the surfaces along the tab portions and along adjacent parts of the body portions, and each of the tab portion parts is separable from an adjacent tab portion part along one of the perforations between the tab portion parts and is bendable along the perforations along the second edge to engage the cohesive on the tab portion part with the cohesive on the body part and thereby retain the tab portion part folded back along the second edge. This affords leaving only a single selected tab portion part projecting from the second edge of the body portion.

BRIEF DESCRIPTION OF THE DRAWING

The present invention will be further described with reference to the accompanying drawing wherein the thickness of certain of the various layers is exaggerated to more clearly illustrate structures, like reference numerals refer to like parts in the several views, and wherein.

DETAILED DESCRIPTION

Figure 1:
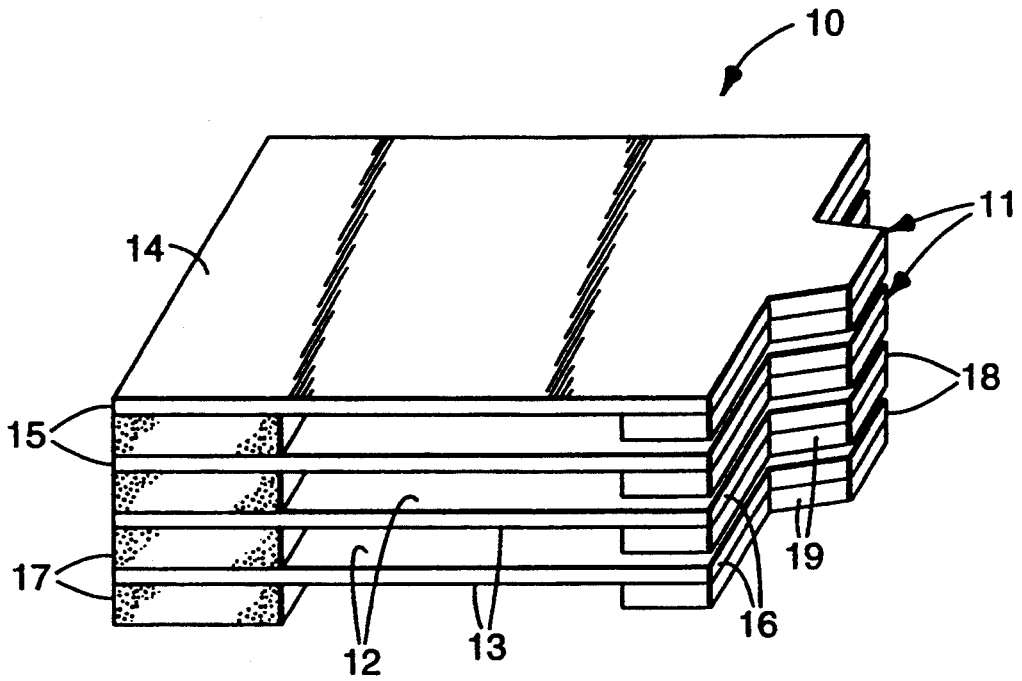
FIG. 1 is a perspective view of a first embodiment of a pad assembly according to the present invention.

Referring now to FIG. 1 of the drawing, there is illustrated a first embodiment of a pad assembly or pad according to the present invention, generally designated by the reference numeral 10.

Generally, the pad assembly 10 comprises a multiplicity of flexible sheets 11. Each sheet 11 has front and rear surfaces 12 and 13, a body portion 14 generally of the same size as the body portion 14 of other sheets 11 in the pad assembly 10 and having peripheral edges including first and second opposite edges 15 and 16; and a tab portion 18 smaller in surface area than the body portion 14, which tab portion 18 projects beyond the second edge 16 of the body portion 14. The body portion 14 has a band 17 of repositionable pressure sensitive adhesive coated on its rear surface 13 adjacent its first edge 15, and the sheets 11 are disposed in a stack with the corresponding peripheral edges of the body portions 14 of the sheets 11 aligned, the front and rear surfaces 15 and 16 of adjacent sheets 11 facing each other, and the band 17 of repositionable pressure sensitive adhesive on each sheet 11 adhering that sheet 11 to the adjacent sheet 11 in the pad assembly 10. An individual sheet 11 may be peeled from the top of the pad assembly 10, and then adhered to the surface of pages in a multi-page document with its tab portion 18 projecting from an edge of the page; whereupon, notes can conveniently be written on the body portion 14 of the sheet, and after the document is closed, a user can easily find the sheet 11 due to its tab portion 18 projecting from the edge of the page to which the sheet 11 is adhered.

While the sheets 11 could be of a polymeric material and have front surfaces 15 adapted to be written on, preferably the sheets 11 are of paper, and each of the sheets 11 includes a reinforcing layer 19 along one surface of its tab portion 18 and along the surface of an adjacent minor part of the body portion 14 of the sheet 11 to restrict tearing of the sheet 11 adjacent its tab portion 18. That reinforcing layer 19 can be provided by a coating of a polymeric material that adds strength to the paper sheet (e.g., vinyl polymers, rubber polymers, polyolefins, other organic polymers, silicone polymers, and the like), or can be a layer 19 of polymeric material adhered to the sheet 11 by a suitable adhesive (e.g., the pressure sensitive adhesive coated tape sold under the trade designation "Scotch" (t.m.) brand #810 tape by Minnesota Mining and Manufacturing Company, St. Paul, Minn.). As illustrated in FIG. 1, the reinforcing layers 19 can be on the rear surfaces 13 of the sheets 11; however, alternatively, the reinforcing layers 19 could be on the front surfaces 12 of the sheets 11, or could be on both surfaces. Also, the reinforcing layers 19 can be transparent or can be brightly colored in colors contrasting with the color of the sheets 11, with the same or different colors being used on the different sheets 11 in the pad assembly 10.

Figure 2:
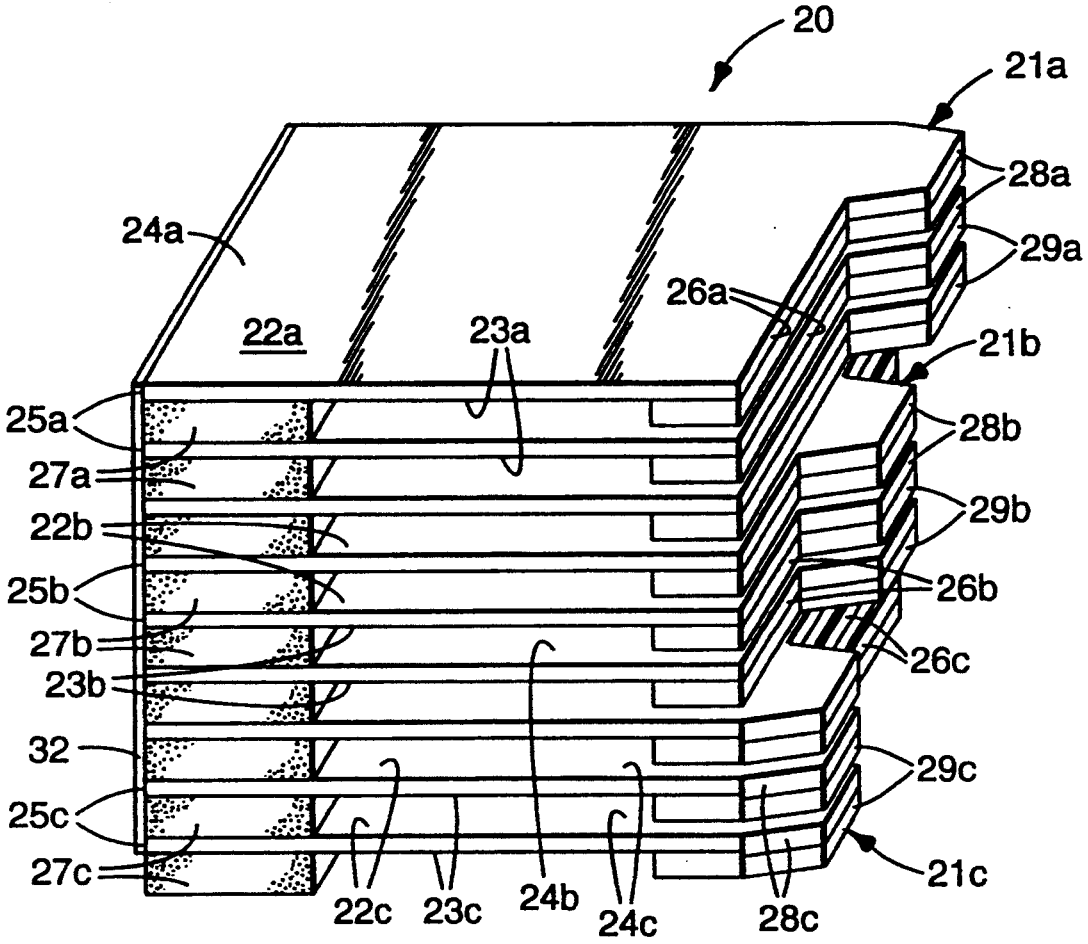
FIG. 2 is a perspective view of a second embodiment of a pad assembly according to the present invention.
Figure 3:
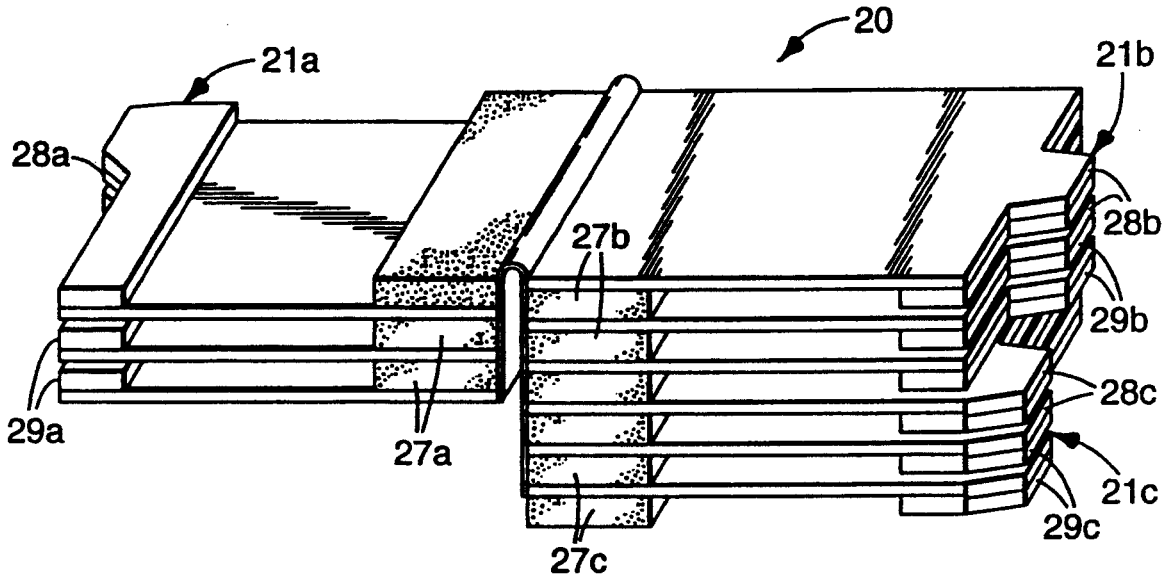
FIG. 3 is a perspective view of the pad assembly of FIG. 2 in which sheets in the pad assembly have been separated but are retained in the pad assembly by a layer of padding material along aligned edges of the sheets.

Referring now to FIGS. 2 and 3 of the drawing, there is illustrated a second embodiment of a pad assembly or pad according to the present invention, generally designated by the reference numeral 20.

Generally, the pad assembly 20 comprises a multiplicity of flexible sheets **21*a*, a multiplicity of flexible sheets 21*b*, and a multiplicity of flexible sheets 21*c*, each of which sheets 21*a*, 21*b* and 21*c* has front and rear surfaces 22*a*, 22*b*, 22*c* and 23*a*, 23*b*, 23*c* respectively, a body portion 24*a*, 24*b*, 24*c* respectively generally of the same size having peripheral edges including first and second opposite edges 25*a*, 25*b*, 25*c* and 26*a*, 26*b*, 26*c* respectively; and a tab portion 28*a*, 28*b*, 28*c* respectively that is smaller in surface area than the body portion 24*a*, 24*b* or 24*c*, which tab portion 28*a*, 28*b* or 28*c* projects beyond the second edge 26*a*, 26*b* or 26*c* of the body portion 24*a*, 24*b* or 24*c*. The body portion 24*a*, 24*b* or 24*c* has a band 27*a*, 27*b*, 27*c* respectively of repositionable pressure sensitive adhesive coated on its rear surface 23*a*, 23*b* or 23*b* and the sheets 21*a*, 21*b* and 21*c* are disposed in a stack with the corresponding peripheral edges of the body portions 24*a*, 24*b* and 24*c* of the sheets 21*a*, 21*b* and 21*c* aligned, the front and rear surfaces of adjacent sheets facing each other, and the band 27*a*, 27*b* or 27*c* of repositionable pressure sensitive adhesive on each sheet 21*a*, 21*b* or 21*c* adhering that sheet to the adjacent sheet in the pad assembly 20. Each of the sheets 21*a*, 21*b* and 21*c* includes a reinforcing layer 29*a*, 29*b* or 29*c* along one surface of its tab portion 28*a*, 28*b*** or 28c and along the surface of an adjacent minor part of the body portion 24a, 24b, or 24c of the sheet 21a, 21b or 21c to restrict tearing of the sheet adjacent its tab portion 28a, 28b or 28c; which reinforcing layer 29a, 29b or 29c are layers of transparent polymeric material adhered to the sheet 21a, 21b or 21c on the rear surfaces 23a, 23b, and 23c of the sheets 21a, 21b, or 21c. Preferably, the sheets 21a, 21b, and 21c are brightly colored in different contrasting colors.

The pad assembly 20 also includes a layer 32 of padding compound disposed over and releasably adhered to the aligned first edges 15a, 15b and 15c of the sheets in the pad assembly 20, which layer 32 of padding compound is sufficiently flexible to allow (see FIG. 3), after the band of repositionable pressure sensitive adhesive 17a on the rear surface of one of the sheets 21a in the pad assembly 20 is separated from the front surface 12b of the adjacent sheet 21b in the pad assembly 20, that one sheet 21a to be pivoted away from that adjacent 21b sheet by hinge-like flexing of the layer 32 of padding compound between the sheets 21a, 21b. The layer 32 of padding compound is sufficiently adhered to the sheets 21a, 21b, and 21c to remain adhered to the adjacent sheets 21a and 21b during such flexing while affording manual peeling (not shown) of one of the separated sheets 21a or 21b from the layer 32 of padding compound to separate that sheet from the pad assembly 20.

Figure 4:
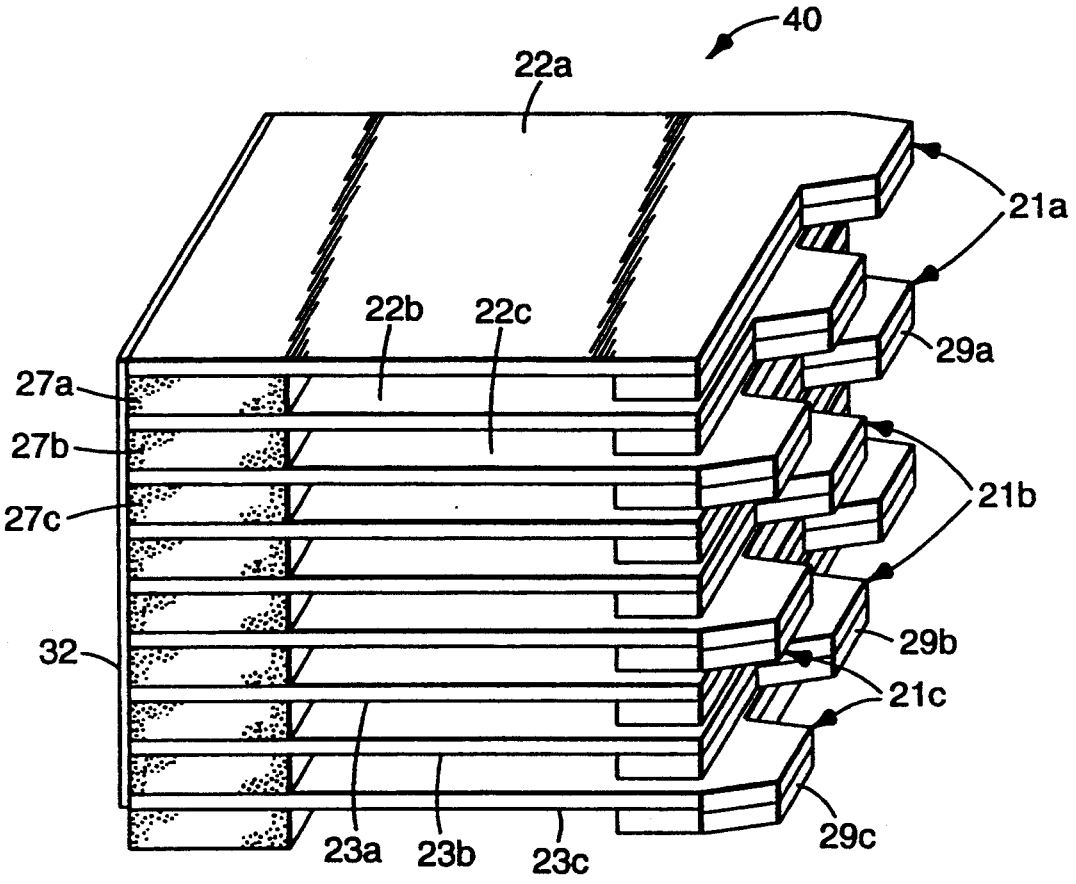
FIG. 4 is a perspective view of a third embodiment of a pad assembly according to the present invention.

Referring now to FIG. 4 of the drawing, there is illustrated a third embodiment of a pad assembly according to the present invention, generally designated by the reference numeral 40. The pad assembly 40 comprises the same flexible sheets 21a, 21b and 21c described above with reference to FIGS. 2 and 3, however, instead of the sheets of each of the sets of sheets 21a, 21b and 21c being disposed adjacent each other in the pad assembly as they are in the pad assembly 20, the sheets of each of the sets of sheets 21a, 21b and 21c are interspersed between sheets of different sets of sheets in a predetermined pattern throughout the pad assembly 40. Such positioning of the sheets may provide the advantage that successive topmost sheets have different colors and/or tab portion locations, eliminating the need to open the pad to successively access sheets with those different features.

Figure 5:
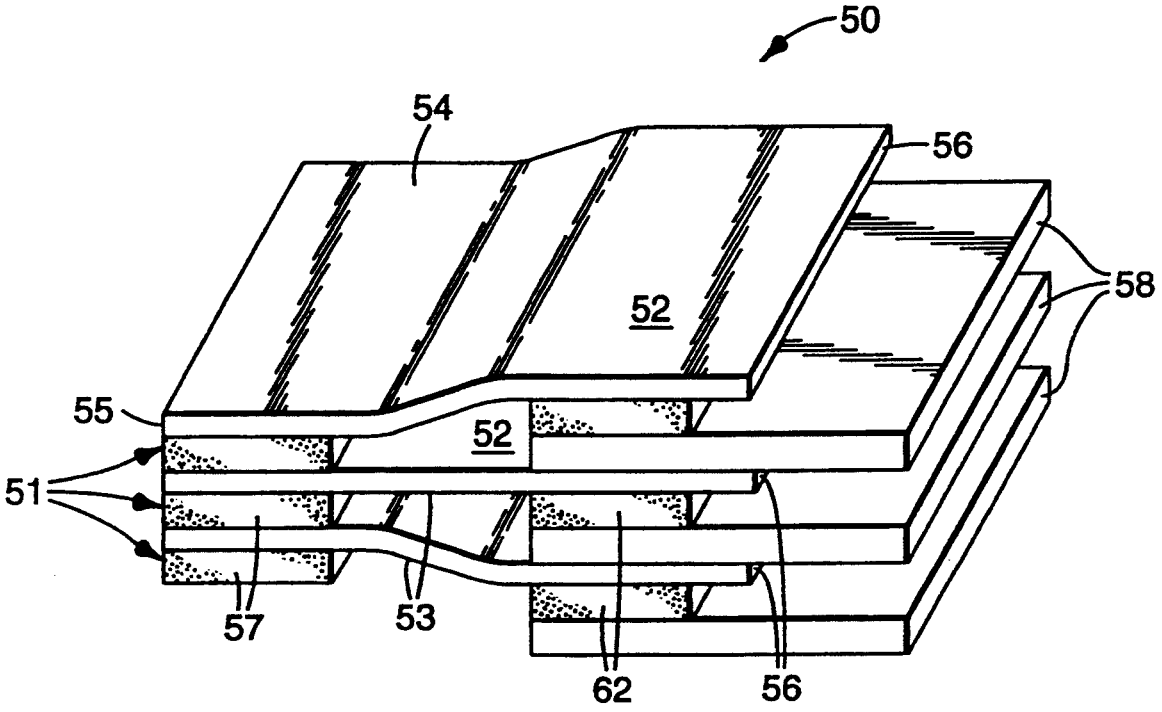
FIG. 5 is a perspective view of a fourth embodiment of a pad assembly according to the present invention.

Referring now to FIG. 5 of the drawing, there is illustrated a fourth embodiment of a pad assembly or pad according to the present invention, generally designated by the reference numeral 50.

Generally, the pad assembly 50 comprises a multiplicity of flexible sheets or sheet assemblies 51, each having front and rear surfaces 52 and 53. Each sheet includes a paper body portion 54 generally of the same size having peripheral edges including first and second opposite edges 55 and 56, and a polymeric brightly colored tab portion 58 smaller in surface area than the body portion 54, which tab portion 58 projects beyond the second edge 56 of the body portion 54. The body portion 54 of each sheet 51, which is a conventional note of the type sold in pads under the trademark "Post-it" Note Pads, has a band 57 of repositionable pressure sensitive adhesive coated on its rear surface 53 adjacent its edge 55, and the sheets 51 are disposed in a stack with the corresponding peripheral edges of the body portions 54 of the sheets 51 aligned, the front and rear surfaces 55 and 56 of adjacent sheets 51 facing each other, and the band 57 of repositionable pressure sensitive adhesive on each sheet 51 adhering that sheet 51 to the adjacent sheet 51 in the pad assembly 50. The tab portion 58 of each sheet 51 is provided by the adhesive free colored end part of a flexible polymeric sheet 60 (e.g., of cellulose acetate) included in a tape flag sold under the trademark "Post-it" Tape Flags by Minnesota Mining and Manufacturing Company, which sheet 60 has a layer 62 of repositionable adhesive on its end opposite the tab portion 58 by which the tape flag and thus the tab portion 58 is adhered to one side surface of the body portion 54 (see U.S. Pat. No. 4,770,320, the content whereof is incorporated herein by reference). The tab portions 58 of the sheets 51 can be of the same or different colors. An individual sheet 51 may be peeled from the top of the pad assembly 50, and then adhered by the band of adhesive 57 to the surface of a page in a multi-page document in a position where the paper body portion 54 can be easily written on, whereupon the brightly colored polymeric tab portion 58 may be peeled from the body portion 54 and adhered to that page by the adhesive layer 62 with the tab portion 58 projecting from its edge; whereupon, notes can conveniently be written on the body portion 54 of the sheet, and after the document is closed, a user can easily find the body portion 54 due to the tab portion 58 projecting from the edge of the page to which the body portion 51 is adhered.

Figure 6:
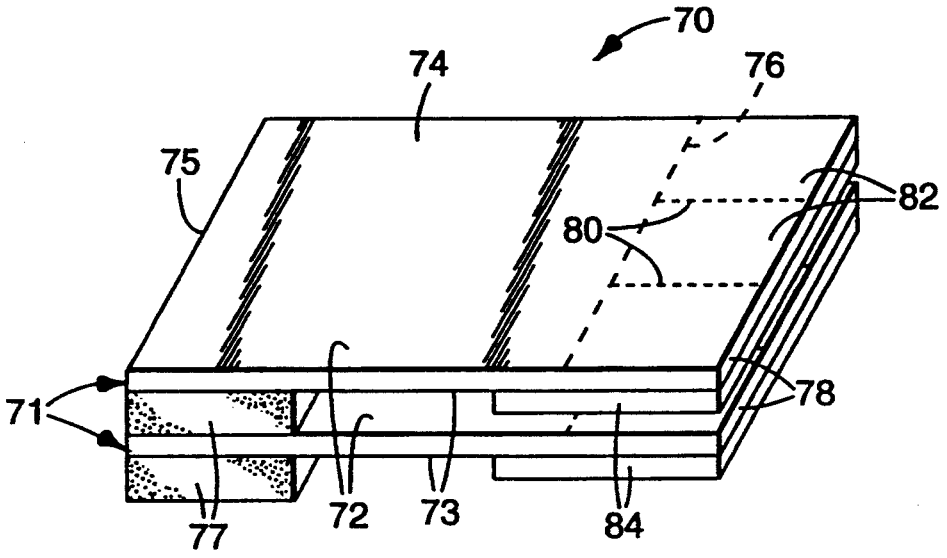
FIG. 6 is a perspective view of a fifth embodiment of a pad assembly according to the present invention.

Referring now to FIG. 6 of the drawing, there is illustrated a fifth embodiment of a pad assembly or pad according to the present invention, generally designated by the reference numeral 70.

Generally, the pad assembly 70 comprises a multiplicity of flexible sheets 71. Each sheet 71 has front and rear surfaces 72 and 73, and a body portion 74 generally of the same size as other body portions 74 of the sheets 71, which body portion 74 has peripheral edges including first and second opposite edges 75 and 76. Each sheet also includes a tab portion 78 smaller in surface area than the body portion 74, which tab portion 78 projects beyond the second edge 76 of the body portion 74. The body portion 74 has a band 77 of repositionable pressure sensitive adhesive coated on its rear surface 73, adjacent its first edge 75, and the sheets 71 are disposed in a stack with the corresponding peripheral edges of the body portions 74 of the sheets 71 aligned, the front and rear surfaces 75 and 76 of adjacent sheets 71 facing each other, and the band 77 of repositionable pressure sensitive adhesive on each sheet 71 adhering that sheet 71 to the adjacent sheet 71 in the stack. The sheets 71 are perforated along their second edges 76 between the body portions 74 and the tab portions 78, and the tab portions 78 are perforated along lines 80 at about right angles to the second edges 76 of the body portions 74 to define a plurality of tab portion parts 82 along the tab portions 78. The sheets 71 include layers 84 of cohesive on their rear surfaces 76 along the tab portions 78 and along adjacent parts of the body portions 74, and each of the tab portion parts 82 is separable from an adjacent tab portion part 82 along one of the lines of perforations 80 between the tab portion parts 82 and is bendable along the perforations along the second edge 76 to engage the cohesive on the tab portion part 82 with the cohesive on the body portion 74 and thereby retain the tab portion part 82 folded back along the second edge 76. This affords leaving only a single selected tab portion part 82 projecting from the second edge 76 of the body portion 74.

An individual sheet 71 may be peeled from the top of the pad assembly 70, two of the tab portion parts 82 may be separated and folded back along the body portion 74 in the manner indicated above, leaving only one tab portion part 82 projecting in a desired location with respect to the body portion 74, and the sheet 71 can then be adhered to the surface of a page in a multi-page document with its selected tab portion 78 part 82 projecting from an edge of the page.

The present invention has now been described with reference to several embodiments thereof. It will be apparent to those skilled in the art that many changes can be made in the embodiments described without departing from the scope of the present invention. For example, instead of being stacked with the bands of adhesive between the sheets all on the same side of the pad assemblies as illustrated, those bands of adhesive on successive sheets in the pad assemblies can be positioned on alternate sides of the pad assemblies to provide a "Z-stacked" pad configuration of the type illustrated U.S. Pat. No. 4,416,392, the content whereof is incorporated herein by reference. That "Z-stacked" pad configuration affords dispensing of the sheets in the pad assemblies from dispensers of the type illustrated, for example, in U.S. Pat. Nos. 4,653,666 and 4,921,127, the contents whereof are also incorporated herein by reference. Thus the scope of the present invention should not be limited to the structures described in this application, but only by the structures described by the language of the claims and the equivalents of those structures.

We claim:

1. A pad assembly comprising:

a multiplicity of flexible sheets, each sheet having front and rear surfaces, having a body portion generally of the same size as the body portions of the other sheets, having peripheral edges including first and second opposite edges, having a tab portion smaller in surface area than said body portion projecting beyond said second edge of said body portion, and having a layer of pressure sensitive adhesive on said rear surface of said body portion, said sheets being disposed in a stack with the corresponding peripheral edges of the body portions of the sheets aligned, the front and rear surfaces of adjacent sheets facing each other, and the layer of pressure sensitive adhesive on each sheet releasably adhering that sheet to the adjacent sheet in the stack, and said sheets including a plurality of different sets of sheets with the sheets in each of said sets of sheets having the same peripheral shape and having tabs at a different location along said second edges of said body portions than the locations of the tabs along said second edges of said body portions in the other sets of sheets.

2. A pad assembly according to claim 1 wherein the sheets of each of said sets of sheets are disposed adjacent each other in said stack of sheets.

3. A pad assembly according to claim 1 wherein the sheets of each of said sets of sheets are interspersed between sheets of different sets of sheets throughout said pad assembly.

4. A pad assembly according to claim 1 wherein the sheets of said different sets of sheets are of different colors.

5. A pad assembly comprising:

a multiplicity of flexible sheets of paper, each sheet having front and rear surfaces, having a body portion generally of the same size as the body portions of the other sheets, having peripheral edges including first and second opposite edges, having a tab portion smaller in surface area than said body portion projecting beyond said second edge of said body portion and having a layer of pressure sensitive adhesive that can be removably adhered to a document on said rear surface of said body portion, said sheets being disposed in a stack with the corresponding peripheral edges of the body portions of the sheets aligned, the front and rear surfaces of adjacent sheets facing each other, and the layer of pressure sensitive adhesive on each sheet releasably adhering that sheet to the adjacent sheet in the stack, and each of said sheets including a reinforcing layer along one surface of said tab and along the surface of an adjacent minor part of the main body of the sheet to restrict tearing of said sheet adjacent said tab portions said reinforcing layers being of polymeric material and being on the rear surfaces of said sheets.

6. A pad assembly comprising:

a multiplicity of flexible sheets of paper, each sheet having front and rear surfaces, having a body portion generally of the same size as the body portions of the other sheets having peripheral edges including first and second opposite edges, having a tab portion smaller in surface area than said body portion protecting beyond said second edge of said body portion, and having a layer of pressure sensitive adhesive that can be removably adhered to a document on said rear surface of said body portion, said sheets being disposed in a stack with the corresponding peripheral edges of the body portions of the sheets aligned, the front and rear surfaces of adjacent sheets facing each other and the layer of pressure sensitive adhesive of each sheet releasably adhering that sheet to the adjacent sheet in the stack, and each of said sheets including a reinforcing layer along one surface of said tab and along the surface of an adjacent minor part of the main body of the sheet to restrict tearing of said sheet adjacent said tab portion, said reinforcing layers being of polymeric material, being on the front surfaces of said sheets, being brightly colored, and having colors contrasting to the color of the sheets.

7. A pad assembly comprising:

a multiplicity of flexible sheets, each sheet having front and rear surfaces, having a body portion generally of the same size as the body portions of the other sheets, having peripheral edges including first and second opposite edges, having a tab portion smaller in surface are than said body portion protecting beyond said second edge of said body portion, and having a layer of pressure sensitive adhesive on said rear surface of said body portion, said sheets being disposed in a stack with the corresponding peripheral edges of the body portions of the sheets aligned, the front and rear surfaces of adjacent sheets facing each other, and the layer of pressure sensitive adhesive on each sheet releasably adhering that sheet to the adjacent sheet in the stack, and said body portions are of paper, said tab portions are of polymeric material, said tab portions are free of adhesive, said tab portions are brightly colored, and said tab portions are end portions of polymeric sheets having opposite end portions coated with repositionable pressure sensitive adhesive, said opposite end portions of said polymeric sheets being removably adhered along said surfaces of said body portions.

8. A pad assembly comprising:

a multiplicity of flexible sheets, each sheet having front and rear surfaces, having a body portion generally of the same size as the body portions of the other sheets, having peripheral edges including first and second opposite edges, having a tab portion smaller in surface area than said body portion protecting beyond said second edge of said body portion, and having a layer of pressure sensitive adhesive that can be removably adhered to a document on said rear surface of said body portion, said sheets being disposed in a stack with the corresponding peripheral edges of the body portions of the sheets aligned, the front and rear surfaces of adjacent sheets facing each other, and the layer of pressure sensitive adhesive on each sheet releasably adhering that sheet to the adjacent sheet in the stack, and wherein said sheets are perforated along said second edge between said body portions and said tab portions, and said tab portions are perforated at about right angles to said second edges to define a plurality of tab portion parts along said tab portions, said sheets include layers of cohesive on one of said surfaces including portions of said layers of cohesive along said tab portions and portions of said layers of cohesive along adjacent parts of said body portions, each of said tab portion parts being separable from an adjacent tab portion part along one of said perforations between said tab portion parts and being bendable along said perforations along said second edge to engage the portion of the layer of cohesive on the tab portion part with the portion of the layer of cohesive on the body part and thereby retain the tab portion part folded back along said second edge to thereby afford leaving only a single selected tab portion part projecting from said second edge of said body portion.

9. A pad assembly comprising:

a multiplicity of flexible sheets, each sheet having front and rear surfaces, having a paper body portion generally of the same size as the body portions of the other sheets, having peripheral edges including first and second opposite edges, having a tab portion projecting beyond said second edge of said body portion and having a layer of pressure sensitive adhesive that can be removably adhered to a document on said rear surface of said body portion, said sheets being disposed in a stack with the corresponding peripheral edges of the body portions of the sheets aligned, the front and rear surfaces of adjacent sheets facing each other, and the layer of pressure sensitive adhesive on each sheet adhering that sheet to the adjacent sheet in the stack, said tab portions are of polymeric material, are free of adhesive, are brightly colored, and are end portions of polymeric sheets having opposite end portions coated with pressure sensitive adhesive, said opposite end portions being removably adhered along said side surfaces of said body portions.

10. A pad assembly according to claim 9 wherein said pressure sensitive adhesive on each sheet is repositionable pressure sensitive adhesive, is in a band positioned along said first edge, and is spaced by a large spacing from said second edge.

11. A pad assembly comprising:

a multiplicity of flexible sheets, each sheet having front and rear surfaces, said sheets being transversely perforated to define on one side of the perforation of each of said sheets a body portion of said sheet and on the other side of said perforation a tab portion of said sheet, and said tab portions being perforated at about right angles to said transverse perforations to define a plurality of tab portion parts along said tab portions, said sheets each having a band of pressure sensitive adhesive that can be removably adhered to a document on said rear surface of said body portion and being disposed in a stack with the body portions of the sheets aligned, the front and rear surfaces of adjacent sheets facing each other, and the band of pressure sensitive adhesive on each sheet adhering that sheet to the adjacent sheet in the stack, said sheets include layers of cohesive on one of said surfaces including portions of said layers of cohesive along said tab portions and portions of said layers of cohesive along adjacent parts of said body portion, each of said tab portion parts being separable from an adjacent tab portion part along one of said perforations between said tab portion parts and being bendable along said transverse perforation to engage the portion of the layer of cohesive on the tab portion part with the portion of the layer of cohesive on the body part and thereby retain the tab portion part folded back along said transverse perforation to thereby afford leaving only a single selected tab portion part projecting from said second edge of said body portion.

12. A pad assembly according to claim 11 wherein said band of pressure sensitive adhesive on each sheet is repositionable pressure sensitive adhesive, is positioned along an edge of said sheet opposite said perforation, and is spaced by a large spacing from said perforation.

* * * * *